US009076316B2

(12) United States Patent
Piccolo, III et al.

(10) Patent No.: US 9,076,316 B2
(45) Date of Patent: Jul. 7, 2015

(54) SYSTEM AND METHOD FOR VERIFYING ASSOCIATIONS BETWEEN INTIATING DEVICES AND NOTIFICATIONS APPLICANCES IN ALARM SYSTEMS

(71) Applicants: Joseph Piccolo, III, Fitzwilliam, NH (US); David Dahlstrom, Hubbardston, MA (US)

(72) Inventors: Joseph Piccolo, III, Fitzwilliam, NH (US); David Dahlstrom, Hubbardston, MA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 217 days.

(21) Appl. No.: 13/921,743

(22) Filed: Jun. 19, 2013

(65) Prior Publication Data

US 2014/0375449 A1 Dec. 25, 2014

(51) Int. Cl.
*G08B 29/00* (2006.01)
*G08B 29/02* (2006.01)

(52) U.S. Cl.
CPC ..... *G08B 29/02* (2013.01)

(58) Field of Classification Search
None
See application file for complete search history.

(56) References Cited

U.S. PATENT DOCUMENTS

| | | | | |
|---|---|---|---|---|
| RE41,871 | E * | 10/2010 | Capowski et al. | 340/514 |
| 8,773,254 | B2 * | 7/2014 | Piccolo, III | 340/501 |
| 2005/0280527 | A1 * | 12/2005 | Farley | 340/514 |
| 2010/0315224 | A1 * | 12/2010 | Orsini et al. | 340/516 |
| 2014/0266675 | A1 * | 9/2014 | Piccolo et al. | 340/514 |
| 2014/0266676 | A1 * | 9/2014 | Piccolo et al. | 340/514 |
| 2014/0340215 | A1 * | 11/2014 | Piccolo et al. | 340/514 |

* cited by examiner

*Primary Examiner* — Travis Hunnings
(74) *Attorney, Agent, or Firm* — Kacvinsky Daisak Bluni PLLC

(57) ABSTRACT

A method for verifying associations between initiating devices and notification appliances in an alarm system. The method may include including actuating an initiating device of the alarm system, thereby activating one or more notification appliances that are associated with the initiating device. The method may further include deactivating each notification appliance that is expected to be associated with the actuated initiating device and, at an alarm panel, providing an indication of whether there are any notification appliances that are still active.

20 Claims, 7 Drawing Sheets

SYSTEM AND METHOD FOR VERIFYING ASSOCIATIONS BETWEEN INTIATING DEVICES AND NOTIFICATIONS APPLICANCES IN ALARM SYSTEMS

FIELD OF THE DISCLOSURE

The disclosure relates generally to the field of alarm systems, and more particularly to an improved method for verifying associations between initiating devices and notification appliances in alarm systems.

BACKGROUND OF THE DISCLOSURE

Alarm systems, such as fire alarm and security systems, typically include one or more alarm panels that receive information from various sensors that are distributed throughout a monitored structure or area. For example, a typical fire alarm system may include an alarm panel that is installed at a central location within a building. The alarm panel may be operatively connected to a plurality of initiating devices (e.g., smoke detectors, manually-actuated pull stations, etc.) that are distributed throughout respective areas of the building.

During normal operation of the alarm system, the alarm panel may monitor electrical signals associated with each of the respective initiating devices connected thereto for variations that may represent the occurrence of an alarm condition. For example, a variation in a particular electrical signal may represent the detection of smoke by a smoke detector in a corresponding area of the building in which the smoke detector is located, and may cause the alarm panel to enter an alarm mode. The alarm panel may be configured to respond to such a condition by initiating certain predefined actions, such as by activating one or more notification appliances (e.g. strobes, sirens, public announcement systems, etc.) within the building that are associated with the initiating device that detected the alarm condition.

An important step in the commissioning of alarm systems, and fire alarm systems in particular, is verifying that the actuation of each initiating device in a system results in the activation of a particular notification appliance or group of notification appliances in the system. For example, in an alarm system installed in a fifty story office building, it may be expected that the actuation of an initiating device located on the first floor of the building will cause all of the notification appliances located on the first two floors of the building to be activated. The traditional method for verifying such interoperability of initiating devices and notification appliances in alarm systems involves actuating an initiating device (e.g., pulling a pull station) and subsequently visiting each notification appliance that is expected to be activated in order to observe and confirm such activation. This process must be repeated for every initiating device in the alarm system.

While the above-described verification method is relatively simple and straightforward, it is associated with several significant shortcomings. For example, when performing such verification, all of the notification appliances in an alarm system upon which the verification is performed must be fully activated (e.g., horns must be sounded and strobes must be flashed). This can be highly disruptive and bothersome to occupants of a building.

A further shortcoming associated with the traditional verification method is that it requires a technician or other individual who is performing the verification to visit all of the notification appliances in a building after actuating each initiating device, even if a particular initiating device is only thought to be associated with notification appliances located in a limited area of the building. This is because a misplaced or wrongly-addressed notification appliance located anywhere in the building could be unexpectedly activated as a result of actuating an initiating device that is not intended to be associated therewith. Searching for such "stray appliances" can be extremely time-consuming and therefore very expensive.

SUMMARY

In view of the foregoing, it would be advantageous to provide convenient means for verifying associations between initiating devices and notification appliances in an alarm system wherein such means do not require activation of the notification features of the notification appliances. It would further be advantageous to provide such verification means that do not require an individual performing the verification to physically visit notification appliances in a building other than those that are expected to be activated upon actuation of each initiating device.

An exemplary method in accordance with the present disclosure may include actuating an initiating device of an alarm system, thereby activating one or more notification appliances that are associated with the initiating device. The exemplary method may further include deactivating each notification appliance that is expected to be associated with the actuated initiating device and, at an alarm panel, providing an indication of whether there are any notification appliances that are still active.

Another exemplary method in accordance with the present disclosure may include actuating an initiating device of an alarm system, thereby activating one or more notification appliances that are associated with the initiating device. The method may further include visiting and deactivating each notification appliance that is expected to be associated with the initiating device and, at an alarm panel, providing an indication of whether there are any notification appliances that are still active. The method may further include locating any notification appliances that are still active.

An exemplary alarm system in accordance with the present disclosure may include an alarm panel, an initiating device operatively connected to the alarm panel, and a plurality of notification appliances operatively connected to the alarm panel and associated with the initiating device. The alarm panel may be configured to activate said plurality of notification appliances in response to actuation of the initiating device. The alarm panel may be further configured to determine if any one of said plurality of notification devices associated with the initiating device remains active after at least one of said plurality of notification appliances has been deactivated.

DETAILED DESCRIPTION

Figure 1:
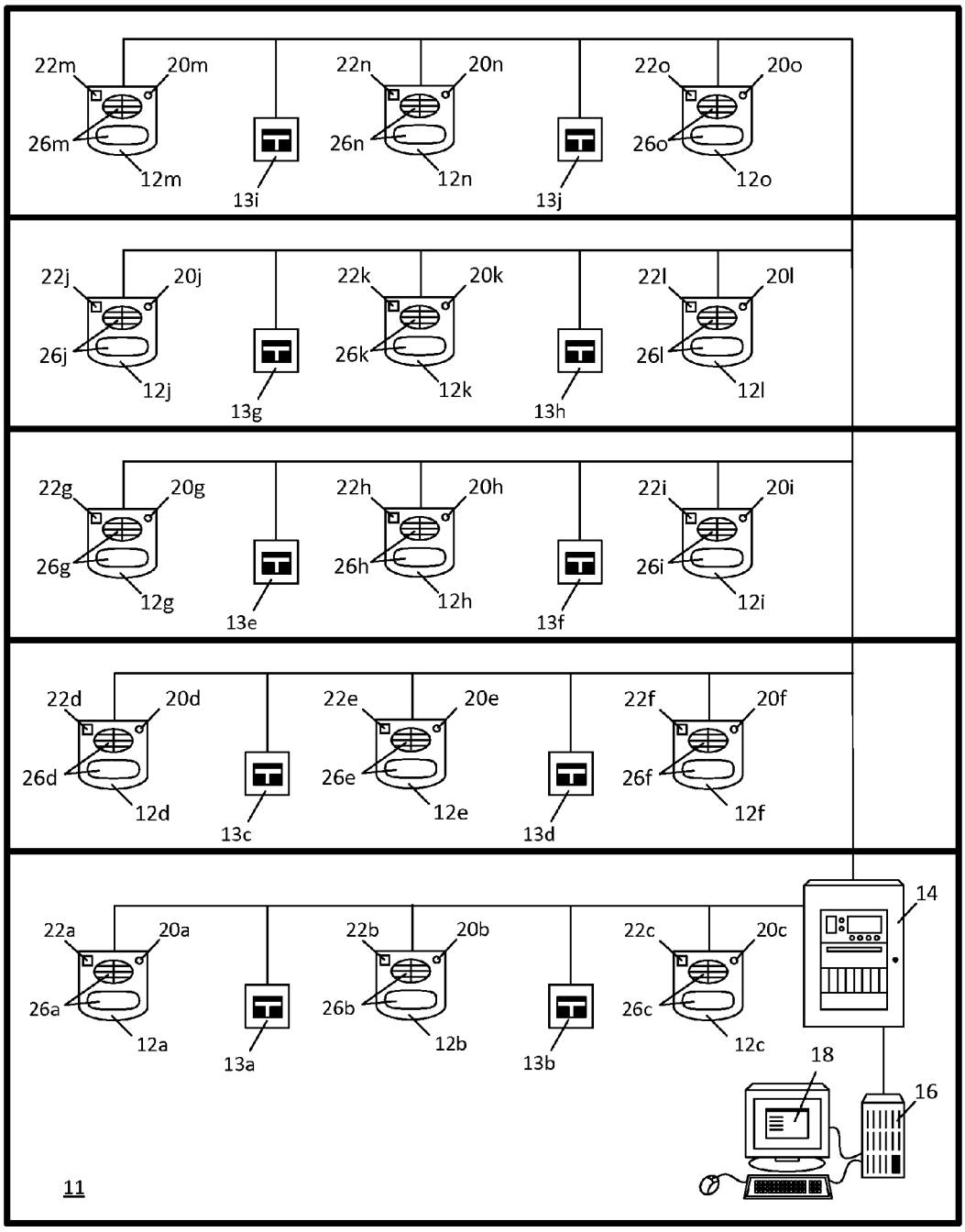
FIG. 1 is a schematic diagram illustrating an exemplary embodiment of an alarm system in accordance with the present disclosure.

Systems and methods for verifying associations between initiating devices and notification appliances in alarm systems in accordance with the present disclosure will now be described more fully hereinafter with reference to the accompanying drawings, in which preferred embodiments of the invention are shown. The disclosed system and methods, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the methods described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area. Many other applications are contemplated and may be implemented without departing from the scope of the present disclosure. All such applications are collectively referred to herein as "alarm systems."

Referring to FIG. 1, an exemplary alarm system 10 in accordance with the present disclosure is shown. The alarm system may be installed in a multi-story building 11, for example. The alarm system 10 may include a plurality of notification appliances 12*a-o* and a plurality of initiating devices 13*a-j* that may be installed throughout the building 11 and connected to one or more alarm panels 14. Each notification appliance 12*a-o* and initiating device 13*a-j* may be associated with a unique address within the alarm system 10 for facilitating identification thereof by the alarm panel 14 and enabling selective routing of command/control signals from the alarm panel 14 to each notification appliance 12*a-o* and initiating device 13*a-j*. The exemplary alarm system 10 includes three notification appliances and two initiating devices located on each floor of the building 11, but it is to be understood that the alarm system 10 may include a greater or fewer number of notification appliances and/or initiating devices disposed in numerous alternative configurations within a structure or area without departing from the scope of the present disclosure.

The notification appliances 12*a-o* may be configured to provide notification of an alarm condition within the building 11 upon manual or automatic actuation of one or more of the initiating devices 13*a-j* in the alarm system 10. Particularly, each initiating device 13*a-j* may be associated with one or more of the notification appliances 12*a-o* such that actuation of each initiating device 13*a-j* will result in the activation of respective, associated notification appliance(s) 12*a-o*. For example, each of the initiating devices 13*a-b* located on the first floor of the building 11 may be associated with all of the notification appliances 12*a-f* located on the first two floors of the building 11. It will be appreciated that many other combinations and permutations of associations between the notification appliances 12*a-o* and initiating devices 13*a-j* in the system exist. All such combinations and permutations are contemplated and may be implemented without departing from the scope of the present disclosure.

The notification appliances 12*a-o* shown in FIG. 1 are strobe/horn units, but it is contemplated that other varieties of notification appliances, including, but not limited to, bells, buzzers, etc., may additionally or alternatively be implemented in the alarm system 10 in a similar manner. The initiating devices 13*a-j* shown in FIG. 1 are manually-actuated pull stations, but it is contemplated that other varieties of manually or automatically actuated initiating devices, including, but not limited to smoke detectors, heat detectors, carbon monoxide detectors, motion detectors, etc., may additionally or alternatively be implemented in the alarm system 10 in a similar manner.

The exemplary alarm system 10 may also include a workstation 16, such as a personal computer (PC) or server, which is operatively connected to the alarm panel 14. The workstation 16 may be loaded with one or more software applications that provide human operators of the system 10 with a user interface 18 for monitoring and controlling certain aspects of the alarm system 10. For example, the user interface 18 may allow an operator to observe the functional status of the notification appliances 12 and initiating devices 13, and to activate, deactivate, observe the functional status of, or otherwise exert control over the notification appliances 12*a-o* and initiating devices 13*a-j* as further described below. Alternatively, it is contemplated that the workstation 16 and user interface 18 may be entirely omitted from the alarm system 10, and that an operator may activate, deactivate, observe the functional status of, or otherwise exert control over the notification appliances 12*a-o* and initiating devices 13*a-j* via the alarm panel 14.

Each of the notification appliances 12*a-o* may be equipped with one or more verification indicia 20*a-o*. The verification indicia 20*a-o* may be configured to be activated upon the actuation of respective, associated initiating devices 13*a-j* as further described below. The verification indicia 20*a-o* may include any type of visual indicia that are capable of being activated in response to an electrical signal, including, but not limited to, light emitting diodes (LEDs), incandescent light bulbs, fluorescent light bulbs, liquid crystal displays (LCDs), strobes, and the like. Such visual indicia 20*a-o* may be prominently located on the exteriors of the notification appliances 12. The verification indicia 20*a-o* may additionally or alternatively include any type of audible indicia that are capable of being activated in response to an electrical signal, including, but not limited to, sirens, horns, bells, buzzers, and the like.

Each of the notification appliances 12*a-o* may be further provided with a manually actuated input device 22*a-o*, such as a switch or a button. The input devices 22*a-o* may be configured such that actuation of an input device 22*a-o* may cause a previously activated verification indicium 20*a-o* of a respective notification appliance 12*a-o* to be deactivated. The purpose and operation of the input devices 22*a-o* will be described in greater detail below within the context of the disclosed verification methods.

The input devices 22*a-o* shown in FIG. 1 may be magnetic switches that are actuated by waving a magnetic key 24 (shown in FIG. 7) in close proximity thereto. Such magnetic keys 24 may be made available to a designated system technician or group of designated system technicians. Limiting access to the input devices 22*a-o* in this manner is advantageous because it prevents unauthorized individuals from interfering with the verification of the alarm system 10. However, it is contemplated that various other types of input devices may additionally or alternatively be implemented without departing from the present disclosure. For example, it is contemplated that the input devices 22*a-o* may be simple buttons or switches that can be actuated by any individual.

Figure 2:
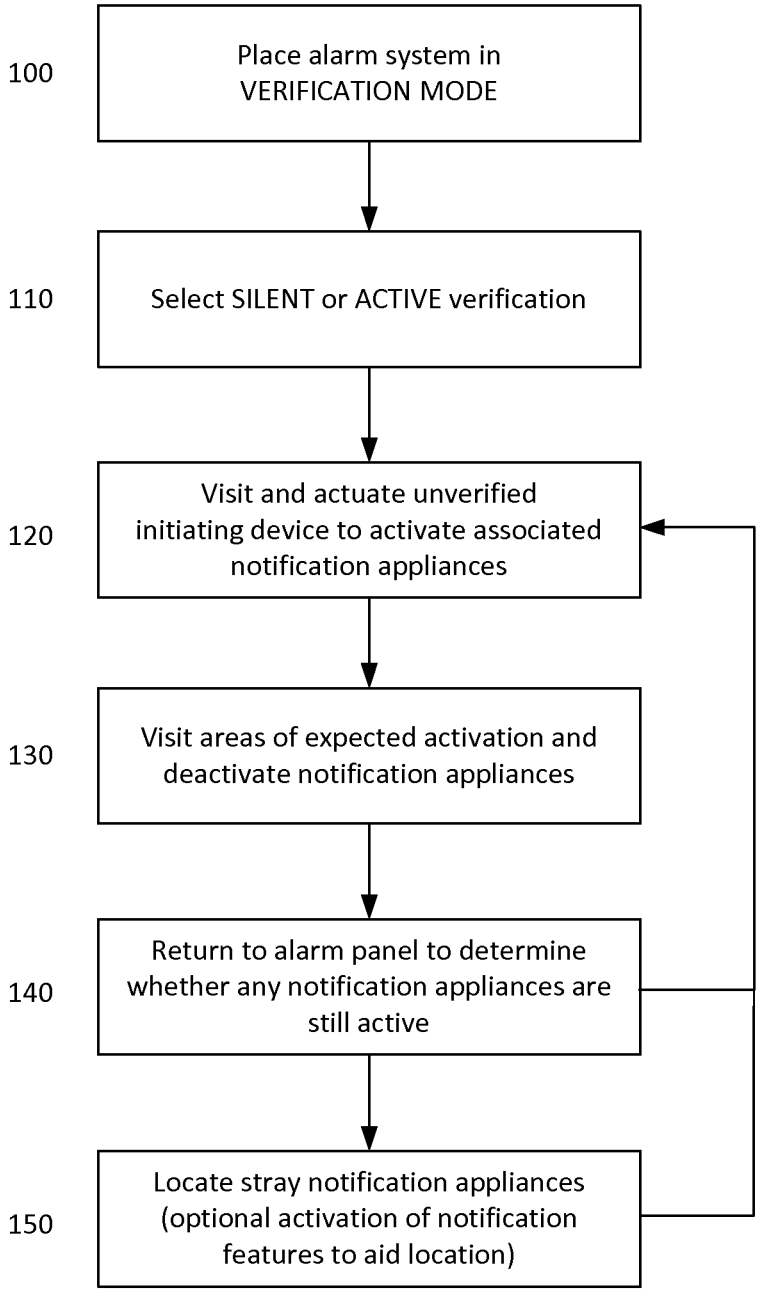
FIG. 2 is a flow diagram illustrating an exemplary embodiment of a method in accordance with the present disclosure.

Referring to FIG. 2, a flow diagram illustrating an exemplary method for verifying associations between the notification appliances 12*a-o* and initiating devices 13*a-j* in the alarm system 10 in accordance with the present disclosure is shown. The method will now be described in detail in conjunction with the schematic representations of the alarm system 10 shown in FIGS. 3-7.

Figure 3:
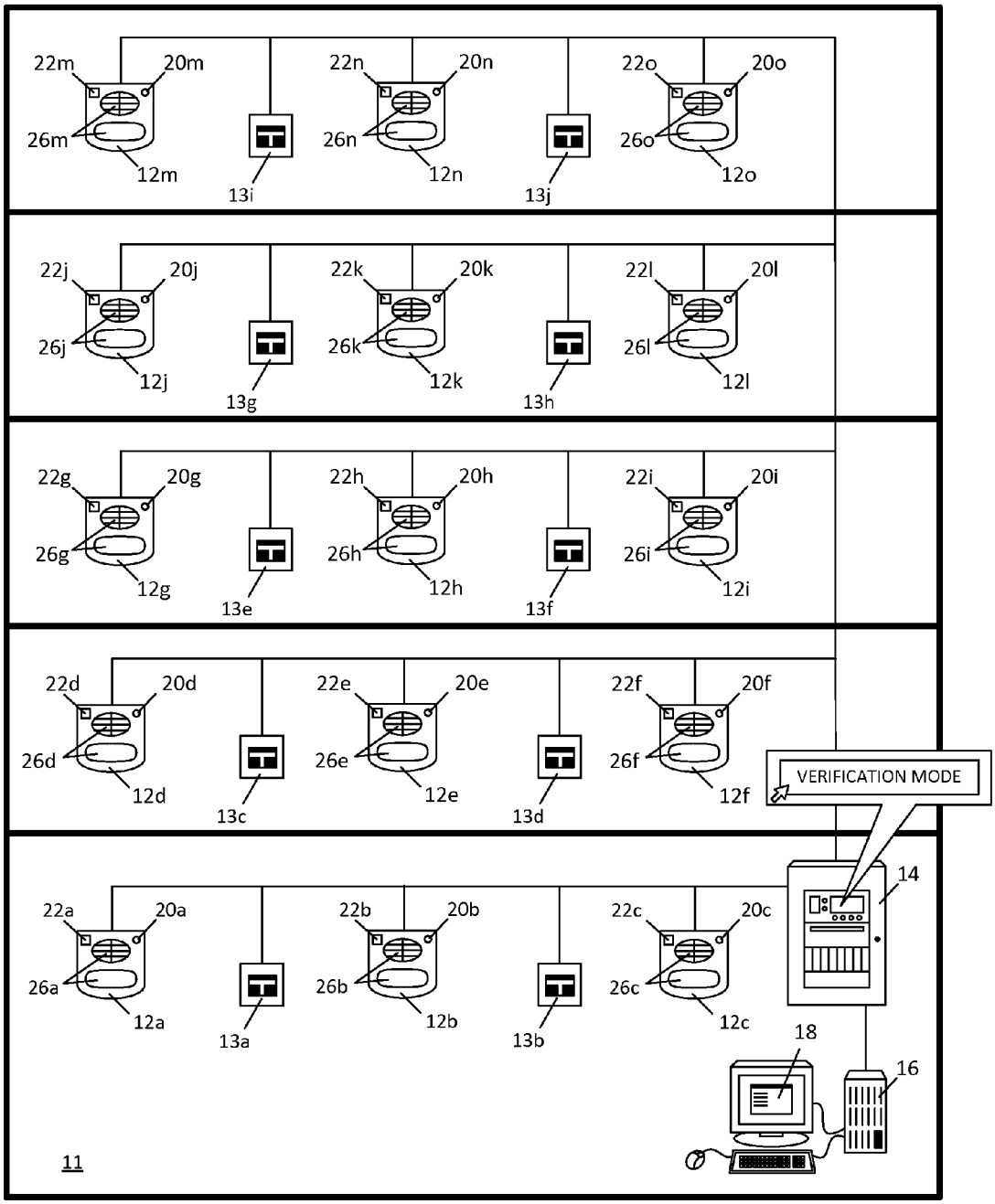
FIGS. 3-7 are a series of schematic diagrams illustrating the exemplary method shown in FIG. 2 being performed on the alarm system shown in FIG. 1.

At a first step 100 of the exemplary testing method, a technician may place the alarm system 10 in a "verification mode." This may be achieved by the technician making an appropriate selection in the user interface 18 or at the alarm panel 14, such as by selecting a "VERIFICATION MODE" option in a menu or sub-menu of the alarm panel 14 as shown in FIG. 3.

Figure 4:
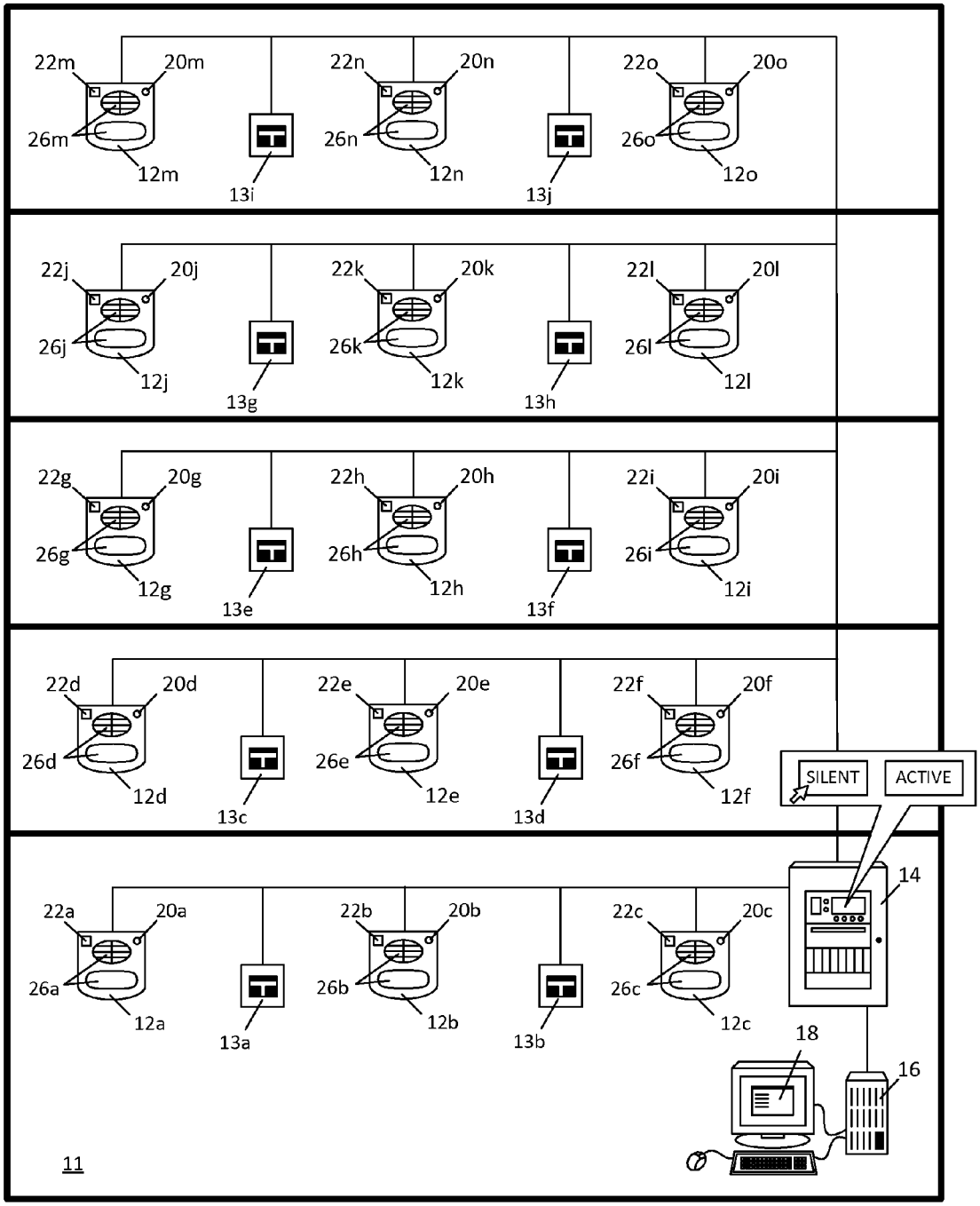

At step 110 of the exemplary method, the technician may be provided with an option to perform either "silent verification" of the notification appliances 12*a-o*, whereby the notification features 26*a-o* of the notification appliances 12*a-o* are not activated during verification (as described below), or "active verification" of the notification appliances 12*a-o*, whereby the notification features 26*a-o* of the notification appliances 12*a-o* are activated during verification (as described below). The technician may initiate either mode of verification by making an appropriate selection in the user interface 18 or at the alarm panel 14 using appropriately configured soft or hard input means, such as by selecting an "SILENT" or "ACTIVE" option in a menu or sub-menu of the alarm panel 14 as shown in FIG. 4. Alternatively, if the alarm system 10 is configured only for silent verification or only for active verification, the technician may not be provided with any such option.

Figure 5:
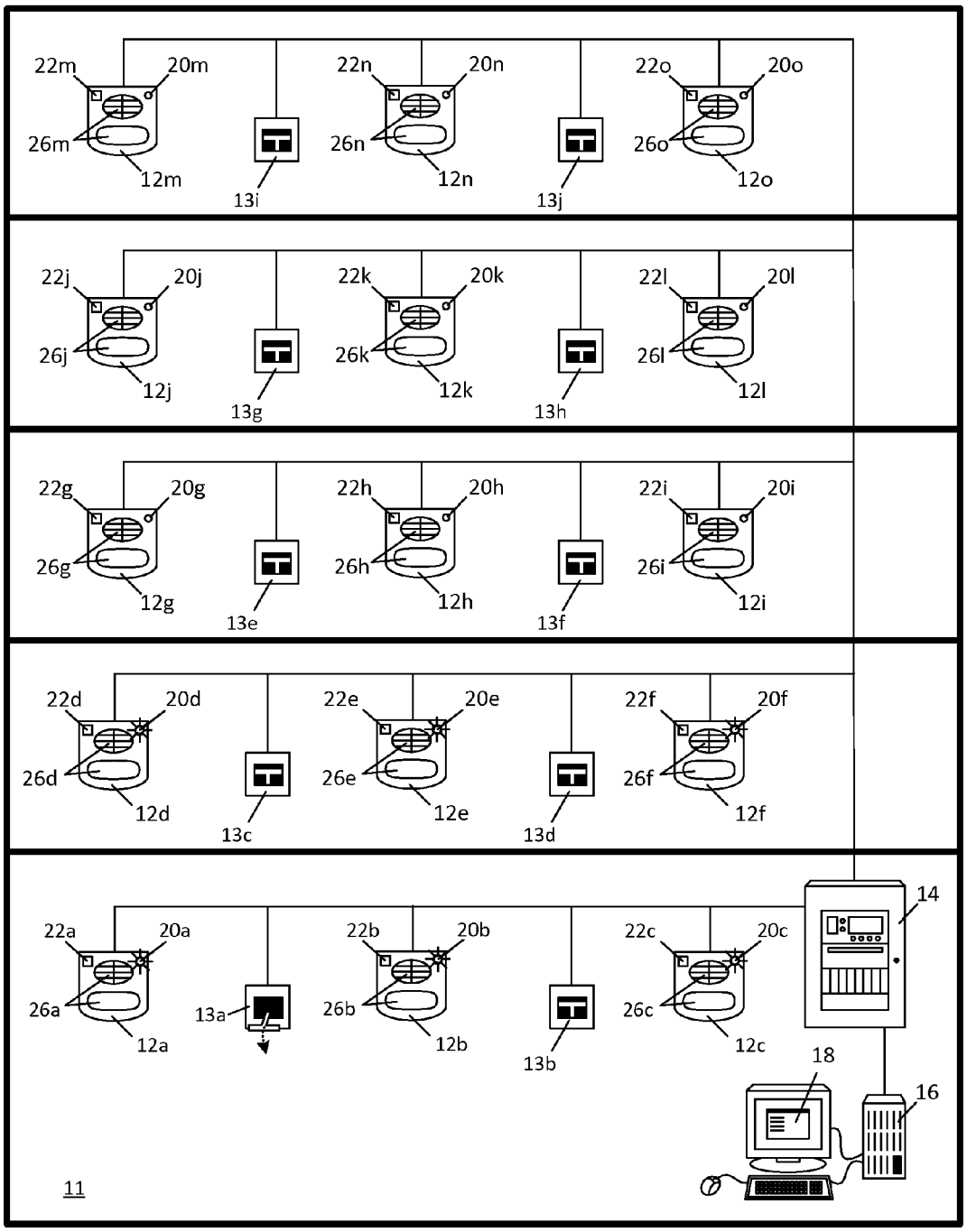
Figure 6:
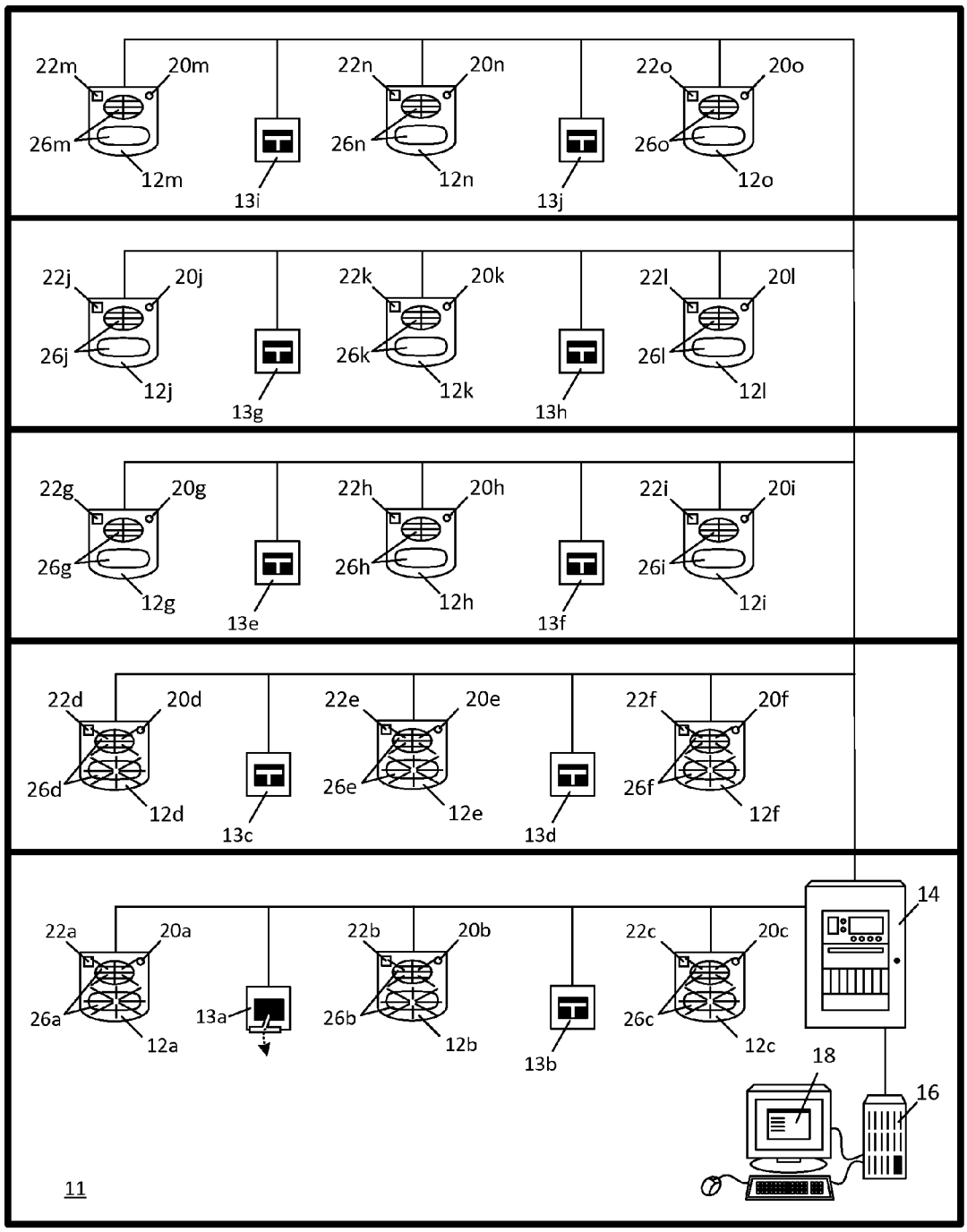

At step 120 of the exemplary method, the technician may visit a first of the initiating devices 13, such as the initiating device 13*a* in FIG. 5, and may actuate the initiating device 13*a*. For example, if the initiating device 13*a* is a manually-actuated pull station as shown in the figures, the technician may pull the handle of the initiating device 13*a*. Actuating the initiating device 13*a* thusly may result in the activation of the notification appliances 12*a-f* on the first two floors of the building 11 that are associated with the initiating device 13*a* (as described above). Particularly, if the silent verification option was selected in step 110 above, or if the alarm system 10 is configured for only silent verification, the verification indicia 20*a-f* of the notification appliances 12*a-f* may be activated as shown in FIG. 5. It should be noted that the notification features 26*a-f* of the notification appliances 12*a-f* are not activated if silent verification was selected. Alternatively, if the active verification option was selected in step 110 above, or if the alarm system 10 is configured for only active verification, the notification features 26*a-f* of the notification appliances 12*a-f* may be activated as shown in FIG. 6. It will therefore be appreciated that performing silent verification of the alarm system 10 will generally be less disruptive to occupants of the building 11 than active verification.

Figure 7:
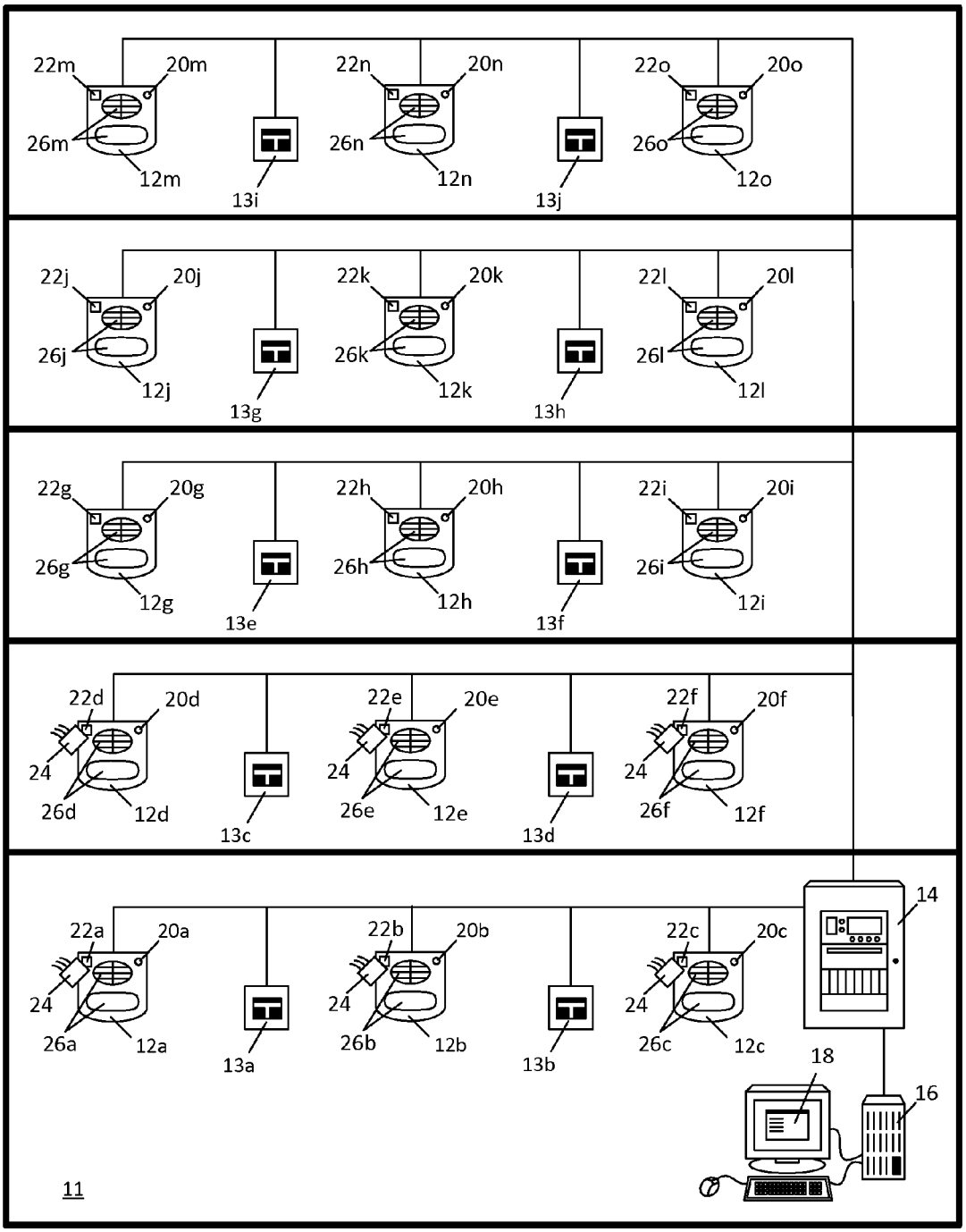

At step 130 of the exemplary method, the technician may perform a walkthrough of the area(s) of the building 11 (e.g., the first two floors) in which all of the notification appliances 12*a-f* that are thought to be associated with the actuated initiating device 13*a* are located. During such walkthrough, the technician may actuate the input devices 22*a-f* of the notification appliances 12*a-f*. For example, the technician may wave a magnetic key 24 (described above) in close proximity to the input devices 22*a-f* as shown in FIG. 7. Actuating the input devices 22*a-f* thusly may result in the verification indicia 20*a-f* of the notification appliances 12*a-f* to be extinguished (i.e., if silent verification was selected in step 110 above), or may cause the notification features 26*a-f* of the notification appliances 12*a-f* to be deactivated (i.e., if active verification was selected in step 110 above).

After the technician has visited and deactivated all of the notification appliances 12*a-f* that were thought to have been activated as a result of actuating the initiating device 13*a*, the technician may, at step 140 of the exemplary method, return to the alarm panel 14. The alarm panel 14 may provide the technician with an indication of whether there any notification appliances in the alarm system 10 that are still active (i.e., that were not visited and deactivated by the technician during his/her walkthrough in step 130). If the alarm panel 14 indicates that there are no notification appliances that are still active, the technician may determine that all of the notification appliances that are associated with the initiating device 13*a* are correctly addressed within the alarm system 10 and are correctly located within the building 11. The technician may then proceed to one of the remaining, unverified initiating devices 13*b-j* in the alarm system 10 and may repeat steps 120-140 above to verify notification appliance associations therewith.

Alternatively, if the alarm panel 14 indicates that there are one or more notification appliances in the alarm system 10 that are still active, the technician may determine, by virtue of the fact that such notification appliances were not found in the areas of expected activation visited by the technician during his/her walkthrough, that such notification appliances are incorrectly addressed within the alarm system 10 and/or are incorrectly located within the building 11. In such a case, the technician may, at step 150 of the exemplary method, walk through the areas of the building 11 (e.g., the third through fifth floors) that were not visited during his/her initial walkthrough and may search for the still active, or "stray," notification appliance(s).

If silent verification was selected in step 110 above, or if the alarm system 14 is configured for only silent verification, the alarm panel 14 may provide the technician with an option to activate the notification features of the stray appliances, thereby making the stray appliances easier to locate. Of course, if active verification was selected in step 110 above, or if the alarm system 10 is configured for only active verification, such an option to activate the notification features will not be necessary since the notification features of the stray appliances will already be active.

Upon locating the stray notification appliances, the technician may deactivate the stray appliances and may further make a note of the physical locations of the stray appliances and/or may take appropriate corrective actions, such as correcting the addresses of the stray appliances within the alarm system 10 and/or relocating the stray appliances within the building 11. The technician may then proceed to one of the remaining, unverified initiating devices 13*b-j* in the alarm system 10 and may repeat steps 120-140 above to verify notification appliance associations therewith.

The method described herein thus provides technicians and other interested parties with convenient means for verifying associations between initiating devices and notification appliances in an alarm system without requiring full activation of the notification features of the notification appliances. Furthermore, the disclosed method does not require an individual performing verification to physically visit notification appliances in a building other than those that are expected to be activated upon actuation of each initiating device, except in the case of stray notification appliances. These features provide significant advantages over existing verification methods which require full activation of notification appliances and/or require an individual to visit all areas of a monitored structure after actuating every initiating device in an alarm system. That is, many existing verification methods require an individual to search an entire building for stray notification appliances after actuating each initiating device as a rule, whereas the verification method of the present disclosure only requires such searching to be performed in exceptional circumstances.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A method for verifying associations between initiating devices and notification appliances in an alarm system, the method comprising:

actuating an initiating device, thereby activating one or more notification appliances that are associated with the initiating device;

deactivating each notification appliance that is expected to be associated with the initiating device; and at an alarm panel, providing an indication of whether there are any notification appliances that are still active.

2. The method of claim 1, wherein activating the one or more notification appliances that are associated with the initiating device comprises activating respective notification indicia of the one or more notification appliances that are associated with the initiating device.

3. The method of claim 1, wherein activating the one or more notification appliances that are associated with the initiating device does not include activating notification features of the one or more notification appliances that are associated with the initiating device.

4. The method of claim 1, wherein activating the one or more notification appliances that are associated with the initiating device includes activating notification features of the one or more notification appliances that are associated with the initiating device.

5. The method of claim 1, further comprising locating the notification appliances that are still active.

6. The method of claim 5, wherein the step of locating the notification appliances that are still active includes activating notification features of the notification appliances that are still active.

7. The method of claim 1, further comprising correcting the address of each notification appliance that is still active.

8. The method of claim 1, further comprising relocating each notification appliance that is still active.

9. The method of claim 1, further comprising placing the alarm system in a verification mode.

10. The method of claim 1, wherein the step of deactivating each notification appliance that is expected to be associated with the initiating device comprises actuating an input device of each notification appliance that is expected to be associated with the initiating device.

11. The method of claim 10, wherein the step of actuating the input device of each notification appliance that is expected to be associated with the initiating device comprises disposing a magnet in close proximity to a magnetic switch in each notification appliance that is expected to be associated with the initiating device.

12. A method for verifying associations between initiating devices and notification appliances in an alarm system, the method comprising:

placing the alarm system in a verification mode;

actuating an initiating device, thereby activating one or more notification appliances that are associated with the initiating device;

visiting and deactivating each notification appliance that is expected to be associated with the initiating device;

at an alarm panel, providing an indication of whether there are any notification appliances that are still active; and locating any notification appliances that are still active.

13. The method of claim 12, wherein activating the one or more notification appliances that are associated with the initiating device comprises activating respective visual notification indicia of the one or more notification appliances that are associated with the initiating device.

14. The method of claim 12, wherein activating the one or more notification appliances that are associated with the initiating device does not include activating notification features of the one or more notification appliances that are associated with the initiating device.

15. The method of claim 12, further comprising correcting the address of each notification appliance that is still active.

16. An alarm system comprising:

an alarm panel;

an initiating device operatively connected to the alarm panel; and a plurality of notification appliances operatively connected to the alarm panel and associated with the initiating device;

wherein the alarm panel is configured to activate said plurality of notification appliances in response to actuation of the initiating device;

the alarm panel further configured to determine if any one of said plurality of notification devices associated with the initiating device remains active after at least one of said plurality of notification appliances has been deactivated.

17. The alarm system of claim 16, wherein activation of said plurality of notification appliances comprises activation of respective visual notification indicia of said plurality of notification appliances.

18. The alarm system of claim 16, wherein activation of said plurality of notification appliances comprises activation of respective notification features of said plurality of notification appliances.

19. The alarm system of claim 16, wherein the alarm panel is further configured to determine which of said plurality of notification appliances are manually deactivated.

20. The alarm system of claim 19, wherein the alarm panel is further configured to cause activation of respective notification features of notification appliances that are not manually deactivated.

* * * * *